US010168069B2

(12) United States Patent
Tanaka

(10) Patent No.: US 10,168,069 B2
(45) Date of Patent: Jan. 1, 2019

(54) AIR-CONDITIONING APPARATUS

(71) Applicant: Mitsubishi Electric Corporation, Tokyo (JP)

(72) Inventor: Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/509,664

(22) PCT Filed: Nov. 4, 2014

(86) PCT No.: PCT/JP2014/079213
§ 371 (c)(1),
(2) Date: Mar. 8, 2017

(87) PCT Pub. No.: WO2016/071955
PCT Pub. Date: May 12, 2016

(65) Prior Publication Data

US 2017/0284713 A1 Oct. 5, 2017

(51) Int. Cl.
*F24F 11/89* (2018.01)
*F25B 40/00* (2006.01)
(Continued)

(52) U.S. Cl.
CPC ..... *F24F 11/89* (2018.01); *F25B 13/00* (2013.01); *F25B 30/02* (2013.01); *F25B 40/00* (2013.01);
(Continued)

(58) Field of Classification Search
CPC ..... F25B 30/02; F25B 41/046; F25B 39/04; F25B 2339/047; F25B 30/04; F25B 30/06;
(Continued)

(56) References Cited

U.S. PATENT DOCUMENTS 8,709,275 B2 * 4/2014 Yana Motta ..... C09K 5/045 252/67
2004/0134225 A1 7/2004 Sakamoto et al.
(Continued)

FOREIGN PATENT DOCUMENTS

JP 61-153356 A 7/1986
JP 02-075863 A 3/1990
(Continued)

OTHER PUBLICATIONS

International Search Report of the International Searching Authority dated Feb. 10, 2015 for the corresponding International application No. PCT/JP2014/079213 (and English translation).
(Continued)

*Primary Examiner* — Frantz Jules
*Assistant Examiner* — Steve Tanenbaum
(74) *Attorney, Agent, or Firm* — Posz Law Group, PLC

(57) ABSTRACT

An air-conditioning apparatus includes a refrigeration cycle and an internal heat exchanger. With the refrigeration cycle, both a cooling operation and a heating operation can be performed. The internal heat exchanger includes a first flow passage guiding refrigerant flowing between an evaporator and a compressor, a second flow passage guiding the refrigerant flowing between an outdoor heat exchanger and an expansion device, a third flow passage guiding the refrigerant flowing between the expansion device and an indoor heat exchanger. The internal heat exchanger is configured to exchange heat between the refrigerant flowing through the first flow passage and the refrigerant flowing through the second flow passage in the cooling operation, and exchange heat between the refrigerant flowing through the first flow passage and the refrigerant flowing through the third flow passage in the heating operation.

9 Claims, 3 Drawing Sheets

(51) Int. Cl.

| | |
|---|---|
| ***F25B 30/02*** | (2006.01) |
| ***F25B 41/04*** | (2006.01) |
| ***F25B 13/00*** | (2006.01) |

(52) U.S. Cl.
CPC .. *F25B 41/046* (2013.01); *F25B 2313/02741* (2013.01); *F25B 2500/05* (2013.01)

(58) Field of Classification Search
CPC ..... F25B 41/062; F25B 40/00; F25B 40/02; F25B 40/04; F25B 40/06; F25B 2400/0417; F25B 2700/131
See application file for complete search history.

(56) References Cited

U.S. PATENT DOCUMENTS

| | | | | |
|---|---|---|---|---|
| 2006/0123840 | A1* | 6/2006 | Lifson et al. | 62/513 |
| 2006/0191280 | A1 | 8/2006 | Kurosawa | |
| 2010/0180612 | A1 | 7/2010 | Kasahara et al. | |

FOREIGN PATENT DOCUMENTS

| | | | | |
|---|---|---|---|---|
| JP | H11-142007 | A | | 5/1999 |
| JP | 2003-97898 | A | | 4/2003 |
| JP | 2005-127711 | A | | 5/2005 |
| JP | 2006-242403 | A | | 9/2006 |
| JP | 2007-93167 | A | | 4/2007 |
| JP | 2008-096093 | A | | 4/2008 |
| JP | 2010-175204 | | * | 8/2010 |
| JP | 2010-175204 | A | | 8/2010 |
| JP | 2011-179689 | | * | 9/2011 |
| JP | 2011-179689 | A | | 9/2011 |
| JP | 2012-107858 | A | | 6/2012 |
| JP | 2014-132217 | A | | 7/2014 |
| JP | 2014-194313 | A | | 10/2014 |

OTHER PUBLICATIONS

Office Action dated Jan. 5, 2016 issued in the corresponding Japanese patent application No. 2015-545235 (and English translation).

* cited by examiner

AIR-CONDITIONING APPARATUS

CROSS REFERENCE TO RELATED APPLICATION

This application is a U.S. national stage application of PCT/JP2014/079213 filed on Nov. 4, 2014, the contents of which are incorporated herein by reference.

TECHNICAL FIELD

The present invention relates to air-conditioning apparatuses, and in particular, relates to an air-conditioning apparatus that can perform both a cooling operation and a heating operation.

BACKGROUND ART

A related-art air-conditioning apparatus having been proposed includes an internal heat exchanger that exchanges heat between refrigerant flowing from a condenser to an expansion device and the refrigerant flowing from an evaporator, thereby increasing the degree of subcooling of the refrigerant flowing from the condenser to improve the performance of a refrigeration cycle. Also, a related-art air-conditioning apparatus that can perform both a cooling operation and a heating operation having been proposed includes the above-described internal heat exchanger, thereby increasing the degree of subcooling of the refrigerant flowing from the condenser to improve the performance of the refrigeration cycle in both the cooling operation and the heating operation (see Patent Literatures 1 and 2).

In more detail, an air-conditioning apparatus described in Patent Literature 1 includes two internal heat exchangers on both sides of an expansion device to increase the degree of subcooling of refrigerant flowing from a condenser in both the cooling operation and the heating operation. That is, the air-conditioning apparatus described in Patent Literature 1 includes an internal heat exchanger between the expansion device and an outdoor heat exchanger that serves as the condenser in the cooling operation and an internal heat exchanger between the expansion device and the indoor heat exchanger that serves as the condenser in the heating operation.

An air-conditioning apparatus described in Patent Literature 2 includes two expansion devices on both sides of an internal heat exchanger to increase the degree of subcooling of refrigerant flowing from a condenser in both the cooling operation and the heating operation. That is, the air-conditioning apparatus described in Patent Literature 2 includes an expansion device that expands the refrigerant cooled by the internal heat exchanger in the cooling operation and an expansion device that expands the refrigerant cooled by the internal heat exchanger in the heating operation. Patent Literature 2 also discloses an air-conditioning apparatus in which a bridge circuit including four check valves is provided in a refrigeration cycle to increase the degree of subcooling of the refrigerant flowing from the condenser in both the cooling operation and the heating operation using a single internal heat exchanger and a single expansion device.

CITATION LIST

Patent Literature

Patent Literature 1: Japanese Unexamined Patent Application Publication No. 2-75863 (FIG. 1)

Patent Literature 2: Japanese Unexamined Patent Application Publication No. 2007-93167 (FIGS. 2, 4)

SUMMARY OF INVENTION

Technical Problem

As described above, the related-art air-conditioning apparatus that can perform both the cooling operation and the heating operation needs two internal heat exchangers or two expansion devices to increase the degree of subcooling of the refrigerant flowing from the condenser. Thus, in the related-art air-conditioning apparatus that can perform both the cooling operation and the heating operation, the cost of the air-conditioning apparatus is increased and the size of the air-conditioning apparatus is increased.

Here, Patent Literature 2 also discloses the related-art air-conditioning apparatus that can perform both the cooling operation and the heating operation and increases the degree of subcooling of the refrigerant flowing from the condenser by using a single internal heat exchanger and a single expansion device. However, this related-art air-conditioning apparatus needs a bridge circuit including four check valves in a refrigeration cycle. Consequently, as is the case with the related-art air-conditioning apparatus including two internal heat exchangers or two expansion devices, in this related-art air-conditioning apparatus, the cost of the air-conditioning apparatus is increased and the size of the air-conditioning apparatus is increased. Also, in the related-art air-conditioning apparatus provided with the bridge circuit including four check valves in the refrigeration cycle, when two-phase gas-liquid refrigerant flows into a check valve, noise is generated due to reciprocating motion of the valve.

The present invention has been made to solve at least one of the above-described problems. An object of the present invention is to obtain, as an air-conditioning apparatus that can perform both a cooling operation and a heating operation and increase the degree of subcooling of refrigerant flowing from a condenser, an air-conditioning apparatus with which the cost and space can be reduced compared to the related-art air-conditioning apparatuses.

Solution to Problem

An air-conditioning apparatus according to an embodiment of the present invention includes a compressor, a flow switching device, a heat source side heat exchanger, an expansion device, a use side heat exchanger, and an internal heat exchanger. The compressor is configured to compress refrigerant. The flow switching device is configured to switch a flow passage of the refrigerant discharged from the compressor between a flow passage used for a cooling operation and a flow passage used for a heating operation. The heat source side heat exchanger serves as a condenser in the cooling operation and as an evaporator in the heating operation. The expansion device is configured to expand and decompress the refrigerant. The use side heat exchanger serves as an evaporator in the cooling operation and as a condenser in the heating operation. The internal heat exchanger includes a first flow passage guiding the refrigerant flowing between the evaporator and the compressor, a second flow passage guiding the refrigerant flowing between the heat source side heat exchanger and the expansion device, and a third flow passage guiding the refrigerant flowing between the expansion device and the use side heat exchanger. The internal heat exchanger is configured to exchange heat between the refrigerant flowing through the first flow passage and the refrigerant flowing through the second flow passage in the cooling operation, and exchange heat between the refrigerant flowing through the first flow passage and the refrigerant flowing through the third flow passage in the heating operation.

Advantageous Effects of Invention

The air-conditioning apparatus according to the embodiment of the present invention includes the internal heat exchanger that includes the first flow passage guiding the refrigerant flowing between the evaporator and the compressor, the second flow passage guiding the refrigerant flowing between the heat source side heat exchanger and the expansion device, and the third flow passage guiding the refrigerant flowing between the expansion device and the use side heat exchanger. The internal heat exchanger is configured to exchange heat between the refrigerant flowing through the first flow passage and the refrigerant flowing through the second flow passage in the cooling operation and exchange heat between the refrigerant flowing through the first flow passage and the refrigerant flowing through the third flow passage in the heating operation. Thus, with the air-conditioning apparatus according to the embodiment of the present invention, only by using a single internal heat exchanger and a single expansion device, the degree of subcooling of the refrigerant flowing from the condenser can be increased to improve the performance of the refrigeration cycle in both the cooling operation and the heating operation. Consequently, with the air-conditioning apparatus according to the embodiment of the present invention, the cost and space can be reduced compared to the related art air-conditioning apparatus.

DESCRIPTION OF EMBODIMENTS

Embodiment 1

Figure 1:
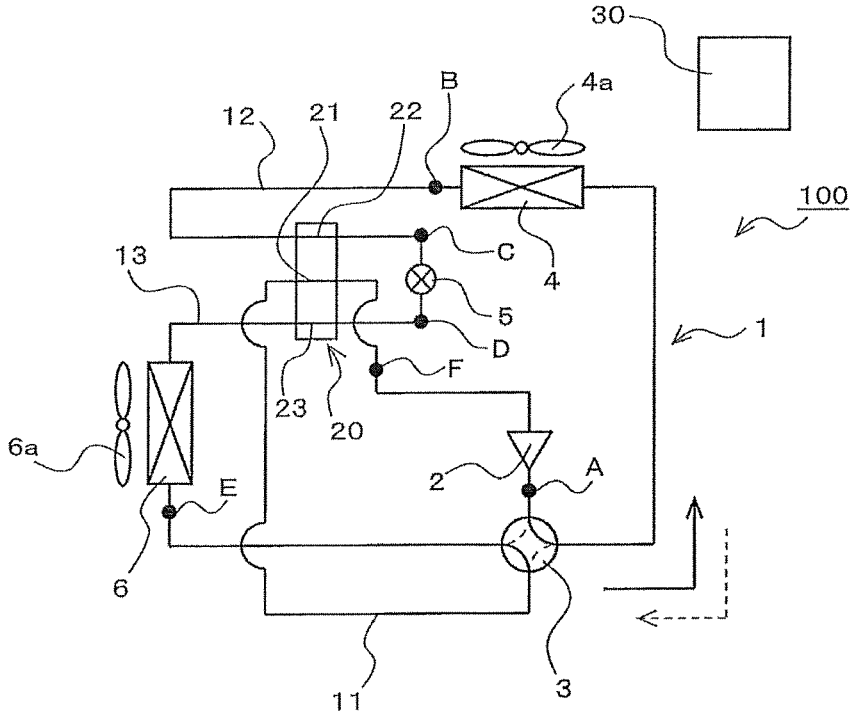
FIG. 1 is a configuration diagram of an air-conditioning apparatus according to Embodiment 1 of the present invention.

FIG. 1 is a configuration diagram of an air-conditioning apparatus according to Embodiment 1 of the present invention. In FIG. 1, arrows other than leader lines indicate directions of refrigerant flows.

An air-conditioning apparatus 100 according to Embodiment 1 includes a refrigeration cycle 1 formed by sequentially connecting to one another through refrigerant pipes a compressor 2, a flow switching device 3, an outdoor heat exchanger 4, an expansion device 5, and an indoor heat exchanger 6.

Here, the outdoor heat exchanger 4 corresponds to a heat source side heat exchanger of the present invention. Also, the indoor heat exchanger 6 corresponds to a use side heat exchanger of the present invention.

The compressor 2 sucks the refrigerant and compresses the refrigerant into high-temperature high-pressure refrigerant. The type of the compressor 2 is not particularly limited. For example, any of various types of compressing mechanisms such as a reciprocating compressing mechanism, a rotary compressing mechanism, a scrolling compressing mechanism, and a screw compressing mechanism may be used for the compressor 2. The compressor 2 is preferred to be of a type that can be controlled by an inverter so that the compressor 2 operates at variable rotation frequencies. The flow switching device 3 is connected to a discharge port of the compressor 2.

The flow switching device 3 is, for example, a four-way valve and switches a flow passage of the refrigerant discharged from the compressor 2 between a flow passage used for a cooling operation and a flow passage used for a heating operation. In more detail, the flow switching device 3 switches a device to which the discharge port of the compressor 2 is connected to one of the outdoor heat exchanger 4 and the indoor heat exchanger 6 and switches a device to which a suction port of the compressor 2 is connected to the other of the outdoor heat exchanger 4 and the indoor heat exchanger 6. The refrigeration cycle 1 has a configuration in which the compressor 2, the outdoor heat exchanger 4, the expansion device 5, and the indoor heat exchanger 6 are sequentially connected to one another through the refrigerant pipes by connecting the discharge port of the compressor 2 to the outdoor heat exchanger 4 and connecting the suction port of the compressor 2 to the indoor heat exchanger 6. That is, the refrigeration cycle 1 of the air-conditioning apparatus 100 has a cycle configuration in which, to perform the cooling operation, the outdoor heat exchanger 4 serves as a condenser and the indoor heat exchanger 6 serves as an evaporator. Also, the refrigeration cycle 1 has a configuration in which the compressor 2, the indoor heat exchanger 6, the expansion device 5, and the outdoor heat exchanger 4 are sequentially connected to one another through the refrigerant pipes by connecting the discharge port of the compressor 2 to the indoor heat exchanger 6 and connecting the suction port of the compressor 2 to the outdoor heat exchanger 4. That is, the refrigeration cycle 1 of the air-conditioning apparatus 100 has a cycle configuration in which, to perform the heating operation, the indoor heat exchanger 6 serves as the condenser and the outdoor heat exchanger 4 serves as the evaporator. As described above, the suction port of the compressor 2 is connected to one of the heat exchangers that serves as the evaporator out of the outdoor heat exchanger 4 and the indoor heat exchanger 6. At this time, the suction port of the compressor 2 is connected to the evaporator through the flow switching device 3 and a refrigerant pipe 11 that connects the evaporator and the flow switching device 3 to each other.

The outdoor heat exchanger 4 is an air-type heat exchanger that exchanges heat between outdoor air and the refrigerant flowing through the outdoor heat exchanger 4. When the outdoor heat exchanger 4 that is an air-type heat exchanger is used as the heat source side heat exchanger, an outdoor fan 4*a* that supplies the outdoor air, which is a heat exchange target, to the outdoor heat exchanger 4 is preferred to be provided in the vicinity of the outdoor heat exchanger 4. This outdoor heat exchanger 4 is connected to the indoor heat exchanger 6 through the expansion device 5. The heat source side heat exchanger is not limited to the outdoor heat exchanger 4 that is an air-type heat exchanger. The type of the heat source side heat exchanger is only required to be appropriately selected depending on the heat exchange target of the refrigerant. In the case where water or brine is the heat exchange target, the heat source side refrigerant may include a water-type heat exchanger.

The expansion device 5 is, for example, an expansion valve and decompresses and expands the refrigerant. The expansion device 5 is provided between the outdoor heat exchanger 4 and the indoor heat exchanger 6. In more detail, the outdoor heat exchanger 4 and the expansion device 5 are connected to each other through a refrigerant pipe 12. The expansion device 5 and the indoor heat exchanger 6 are connected to each other through a refrigerant pipe 13.

The indoor heat exchanger 6 is an air-type heat exchanger that exchanges heat between the outdoor air and the refrigerant flowing through the indoor heat exchanger 6. When the indoor heat exchanger 6 that is an air-type heat exchanger is used as the use side heat exchanger, an indoor fan 6*a* that supplies indoor air, which is a heat exchange target, to the indoor heat exchanger 6 is preferred to be provided in the vicinity of the indoor heat exchanger 6. The use side heat exchanger is not limited to the indoor heat exchanger 6 that is an air-type heat exchanger. The type of the use side heat exchanger is only required to be appropriately selected depending on the heat exchange target of the refrigerant. In the case where water or brine is the heat exchange target, the use side refrigerant may include a water-type heat exchanger. That is, water or brine having exchanged heat in the use side heat exchanger may be supplied to a room to perform the cooling operation and the heating operation.

Furthermore, the air-conditioning apparatus 100 according to Embodiment 1 includes an internal heat exchanger 20. This internal heat exchanger 20 includes a first flow passage 21, a second flow passage 22, and a third flow passage 23. The first flow passage 21 guides refrigerant flowing between the evaporator (the indoor heat exchanger 6 in the cooling operation and the outdoor heat exchanger 4 in the heating operation) and the compressor 2. The second flow passage 22 guides refrigerant flowing between the outdoor heat exchanger 4 and the expansion device 5. The third flow passage 23 guides refrigerant flowing between the expansion device 5 and the indoor heat exchanger 6. That is, the internal heat exchanger 20 is configured to exchange heat between the refrigerant flowing through the first flow passage 21 and the refrigerant flowing through the second flow passage 22 and exchange heat between the refrigerant flowing through the first flow passage 21 and the refrigerant flowing through the third flow passage 23.

The detailed configuration of the internal heat exchanger 20 will be described later.

The air-conditioning apparatus 100 configured as described above is provided with a controller 30 that controls the opening degree of the expansion device 5. Any one of a variety of known methods with which the flow rate of the refrigerant flowing through the indoor heat exchanger 6 can be controlled to the flow rate appropriate for an air-conditioning load (cooling load, heating load) may be adopted as a method of controlling the opening degree of the expansion device 5. The controller 30 may control the opening degree of the expansion device 5 so that, for example, the difference between the temperature of the refrigerant discharged from the compressor 2 and the condensing temperature of the refrigerant flowing through the condenser falls within a specified temperature range. Alternatively, the controller 30 may control the opening degree of the expansion device 5 so that, for example, the difference between the temperature of the refrigerant flowing from the first flow passage 21 of the internal heat exchanger 20 and sucked into the compressor 2 and the evaporating temperature of the refrigerant flowing through the evaporator falls within a specified temperature range. Alternatively, the controller 30 may control the opening degree of the expansion device 5 so that, for example, the difference between the temperature of the refrigerant flowing from the internal heat exchanger 20 into the expansion device 5 and the condensing temperature of the refrigerant flowing through the condenser falls within a specified temperature range. According to Embodiment 1, the controller 30 also controls rotational frequencies of the compressor 2, the outdoor fan 4*a*, and the indoor fan 6*a*.

For the air-conditioning apparatus 100 configured as described above, the refrigerant circulating in the refrigeration cycle 1 contains at least one of R32 (difluoromethane), HFO1234yf (2,3,3,3-tetrafluoropropene), HFO1234ze (1,3,3,3-tetrafluoropropene), HFO1123 (1,1,2-trifluoroethene), and hydrocarbon.

Next, the detailed configuration of the internal heat exchanger 20 according to Embodiment 1 is described.

Figure 2:
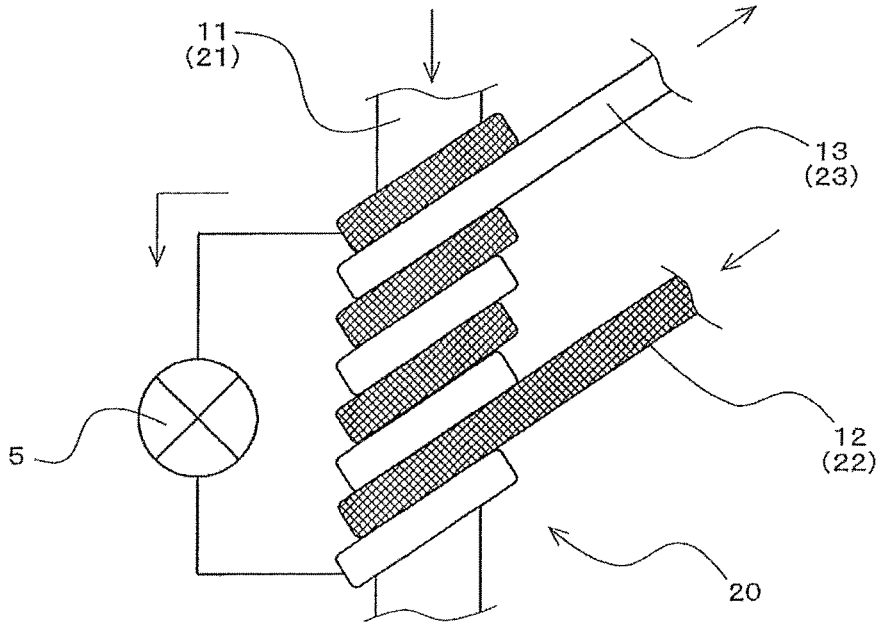
FIG. 2 is a front view of an internal heat exchanger of the air-conditioning apparatus according to Embodiment 1 of the present invention.

FIG. 2 is a front view of the internal heat exchanger of the air-conditioning apparatus according to Embodiment 1 of the present invention. In FIG. 2, the refrigerant pipe 12 is crosshatched to easily distinguish between the refrigerant pipe 12 and the refrigerant pipe 13. Also in FIG. 2, arrows other than leader lines indicate directions of refrigerant flows. The directions of the refrigerant flows are only examples. The refrigerant may flow in opposite directions to the arrow directions.

As illustrated in FIG. 2, the refrigerant pipe 12 between the outdoor heat exchanger 4 and the expansion device 5 and the refrigerant pipe 12 between the expansion device 5 and the indoor heat exchanger 6 are wound around an outer circumference of the refrigerant pipe 11 between the evaporator and the compressor 2 in the internal heat exchanger 20. That is, in the internal heat exchanger 20 according to Embodiment 1, the refrigerant pipe 11 is included in a first heat transfer pipe in which the first flow passage 21 is formed, the refrigerant pipe 12 is included in a second heat transfer pipe in which the second flow passage 22 is formed, and the refrigerant pipe 13 is included in a third heat transfer pipe in which the third flow passage 23 is formed.

In the internal heat exchanger 20 configured as described above, heat is exchanged between the refrigerant flowing through the refrigerant pipe 12 and refrigerant flowing through a range of the refrigerant pipe 11 (a range where the refrigerant pipes 12 and 13 are wound) and heat is exchanged between the refrigerant flowing through the refrigerant pipe 13 and the refrigerant flowing through the range of the refrigerant pipe 11. That is, the internal heat exchanger 20 according to Embodiment 1 is configured as though, in Patent Literature 1, two internal heat exchangers were integrated with each other and refrigerant flowing from evaporators flowed through a common flow passage. Consequently, compared to the two internal heat exchanger described in Patent Literature 1, the cost and space can be reduced with the internal heat exchanger 20 according to Embodiment 1.

Next, operation of the air-conditioning apparatus 100 according to Embodiment 1 is described.

Figure 3:
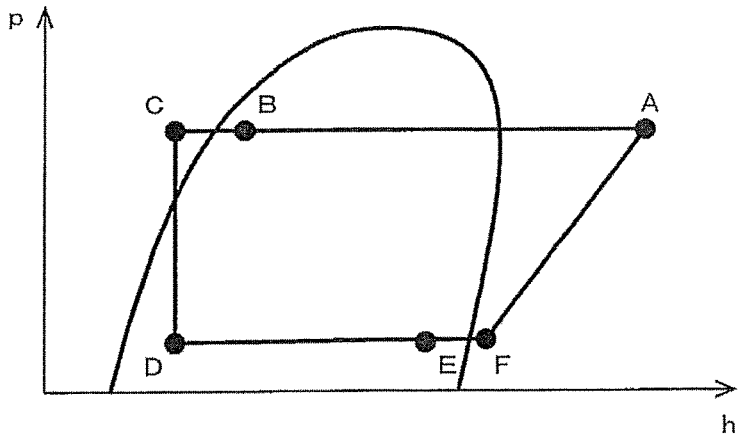
FIG. 3 is a p-h diagram (a diagram illustrating the relationship between a refrigerant pressure p and a specific enthalpy h) for explaining operating states of the air-conditioning apparatus according to Embodiment 1 of the present invention.

FIG. 3 is a p-h diagram (a diagram illustrating the relationship between a refrigerant pressure p and a specific enthalpy h) for explaining operating states of the air-conditioning apparatus according to Embodiment 1 of the present invention. Points A to F of FIG. 3 illustrate states of the refrigerant at points A to F of FIG. 1. The operation of the air-conditioning apparatus 100 according to Embodiment 1 is described below with reference to FIGS. 1 to 3.

[Cooling Operation]

The flow passages in the flow switching device 3 in the cooling operation are indicated by solid lines of FIG. 1. Thus, when the compressor 2 is started up, the refrigerant in the refrigeration cycle 1 flows in a solid arrow direction of FIG. 1. In more detail, when the compressor 2 is started up, the refrigerant is sucked through the suction port of the compressor 2. Then, this refrigerant becomes high-temperature high-pressure gaseous refrigerant and is discharged through the discharge port of the compressor 2 (point A of FIG. 3). The high-temperature high-pressure gaseous refrigerant discharged from the compressor 2 flows into the outdoor heat exchanger 4, transfers heat to the outdoor air, and flows from the outdoor heat exchanger 4.

The refrigerant flowing from the outdoor heat exchanger 4 passes through the refrigerant pipe 12 and flows into the second flow passage 22 of the internal heat exchanger 20. This refrigerant is cooled in the internal heat exchanger 20 by low-temperature refrigerant flowing from the indoor heat exchanger 6 into the first flow passage 21 of the internal heat exchanger 20. Thus, the refrigerant flowing from the outdoor heat exchanger 4 into the second flow passage 22 of the internal heat exchanger 20 is liquefied and flows from the internal heat exchanger 20 (point C of FIG. 3) into the expansion device 5. In FIG. 1, the refrigerant flowing through the first flow passage 21 of the internal heat exchanger 20 and the refrigerant flowing through the second flow passage 22 of the internal heat exchanger 20 are in parallel flow. However, these flows of the refrigerant are only examples. The refrigerant flowing through the first flow passage 21 and the refrigerant flowing through the second flow passage 22 may be in counter flow.

The liquid refrigerant flowing into the expansion device 5 is decompressed by the expansion device 5 to be brought into a low-temperature two-phase gas-liquid state (point D of FIG. 3) and flows from the expansion device 5. The low-temperature two-phase gas-liquid refrigerant flowing from the expansion device 5 passes through the refrigerant pipe 13 and the third flow passage 23 of the internal heat exchanger 20, and flows into the indoor heat exchanger 6. As the temperature of the refrigerant flowing through the third flow passage 23 of the internal heat exchanger 20 is low, this refrigerant passes through the third flow passage 23 while exchanging almost no heat with the refrigerant flowing through the first flow passage 21 of the internal heat exchanger 20. In FIG. 1, the refrigerant flowing through the first flow passage 21 and the refrigerant flowing through the third flow passage 23 in the internal heat exchanger 20 are in counter flow. However, these flows of the refrigerant are only examples. The refrigerant flowing through the first flow passage 21 and the refrigerant flowing through the third flow passage 23 may be in parallel flow.

The refrigerant flowing into the indoor heat exchanger 6 cools the indoor air, and then, flows from the indoor heat exchanger 6 (point E of FIG. 3). Here, as described above, the refrigerant flowing from the outdoor heat exchanger 4 is cooled in the second flow passage 22 of the internal heat exchanger 20 according to Embodiment 1, thereby increasing the degree of subcooling. Thus, the specific enthalpy h of the refrigerant decompressed by the expansion device 5 and flowing into the indoor heat exchanger 6 is small. In other words, point D of FIG. 3 moves closer to a saturated liquid line side (left side). Consequently, the air-conditioning apparatus 100 according to Embodiment 1 can increase a heat exchange amount in the indoor heat exchanger 6. That is, the performance of the refrigeration cycle 1 can be improved.

The refrigerant flowing from the indoor heat exchanger 6 passes through the refrigerant pipe 11 and flows into the first flow passage 21 of the internal heat exchanger 20. This refrigerant is heated in the internal heat exchanger 20 by the low-temperature refrigerant flowing from the outdoor heat exchanger 4 into the second flow passage 22 of the internal heat exchanger 20. Thus, the refrigerant flowing into the first flow passage 21 of the internal heat exchanger 20 is gasified and flows from the internal heat exchanger 20 (point F of FIG. 3). Consequently, the air-conditioning apparatus 100 according to Embodiment 1 can cause the two-phase gas-liquid refrigerant to flow from the indoor heat exchanger 6 (point E of FIG. 3). When the internal heat exchanger 20 is not provided, gaseous refrigerant has to be caused to flow from the indoor heat exchanger 6 to prevent liquid back from occurring in the compressor 2. That is, the gaseous refrigerant flows in the vicinity of an exit of the indoor heat exchanger 6. However, the gaseous refrigerant has a lower heat transfer coefficient compared to that of the two-phase gas-liquid refrigerant. As the air-conditioning apparatus 100 according to Embodiment 1 includes the internal heat exchanger 20, the two-phase gas-liquid refrigerant can be caused to flow from the indoor heat exchanger 6, thereby improving the heat transfer performance of the indoor heat exchanger 6. Consequently, the performance of the refrigeration cycle 1 can be further improved.

The gaseous refrigerant flowing from the first flow passage 21 of the internal heat exchanger 20 is sucked through the suction port of the compressor 2 and compressed into high-temperature high-pressure gaseous refrigerant again by the compressor 2.

Here, when the air-conditioning apparatus 100 is started up, the refrigerant stagnates in (is in the liquid state and stored in) the components such as the outdoor heat exchanger 4. Thus, the flow rate of the refrigerant circulating in the refrigeration cycle 1 is reduced. Also when the refrigerant leaks from the refrigeration cycle 1, the flow rate of the refrigerant circulating in the refrigeration cycle 1 is reduced. In such a state in which the flow rate of refrigerant circulating in the refrigeration cycle 1 is reduced, the refrigerant flowing from the outdoor heat exchanger 4 is easily brought into the two-phase gas-liquid state (point B of FIG. 3). Thus, when the internal heat exchanger 20 is not provided, the two-phase gas-liquid refrigerant flows into the expansion device 5. When the two-phase gas-liquid refrigerant flows into the expansion device 5 as described above, the flow rate of refrigerant flowing through the expansion device 5 becomes unstable, and consequently, the high pressure and the low pressure of the refrigeration cycle become unstable. Furthermore, when the flow rate of refrigerant flowing through the expansion device 5 becomes unstable, the expansion device 5 generates noise.

However, with the air-conditioning apparatus 100 according to Embodiment 1 including the internal heat exchanger 20, even when the two-phase gas-liquid refrigerant flows from the outdoor heat exchanger 4, this refrigerant is cooled by the internal heat exchanger 20, liquefied, and flows into the expansion device 5. Consequently, the air-conditioning apparatus 100 according to Embodiment 1 can prevent the high pressure and the low pressure of the refrigeration cycle from becoming unstable when the air-conditioning apparatus 100 is started up and prevent generation of noise from the expansion device 5.

After a transition period immediately following the startup has elapsed and a stable state has been brought in which the refrigerant stagnating in the components such as the outdoor heat exchanger 4 circulates, the liquid refrigerant or the two-phase gas-liquid refrigerant may be caused to flow through the refrigerant pipe from an exit of the outdoor heat exchanger 4 to the internal heat exchanger 20.

The state in which the liquid refrigerant is caused to flow through the refrigerant pipe from the exit of the outdoor heat exchanger 4 to the internal heat exchanger 20 means a state in which point B shifts further to the left side (subcooled liquid side) than the saturated liquid line in FIG. 3. That is, compared to the case where the two-phase gas-liquid refrigerant flows through the refrigerant pipe from the exit of the outdoor heat exchanger 4 to the internal heat exchanger 20, the specific enthalpy h of the refrigerant decompressed by the expansion device 5 and flowing into the indoor heat exchanger 6 is smaller. In other words, point D of FIG. 3 moves closer to the saturated liquid line side (left side). Thus, compared to the case where the two-phase gas-liquid refrigerant flows through the refrigerant pipe from the exit of the outdoor heat exchanger 4 to the internal heat exchanger 20, when the liquid refrigerant is caused to flow through the refrigerant pipe from the exit of the outdoor heat exchanger 4 to the internal heat exchanger 20, the heat exchange amount in the indoor heat exchanger 6 can be further increased, and consequently, the performance of the refrigeration cycle 1 can be further improved.

In contrast, in the air-conditioning apparatus 100, compared to the case where the liquid refrigerant is caused to flow through the refrigerant pipe from the exit of the outdoor heat exchanger 4 to the internal heat exchanger 20, when the two-phase gas-liquid refrigerant is caused to flow through the refrigerant pipe from the exit of the outdoor heat exchanger 4 to the internal heat exchanger 20, the amount of refrigerant filled in the refrigeration cycle 1 can be reduced. R32, HFO1234yf, HFO1234ze, HFO1123, and hydrocarbon are flammable refrigerants. Consequently, when any of these refrigerants is used, the refrigerant is desired to be prevented from leaking to the room and being stored in the room, and the volume concentration of the refrigerant in the room is desired to be prevented from reaching a flammable concentration range. With the air-conditioning apparatus 100 according to Embodiment 1, by causing the two-phase gas-liquid refrigerant to flow through the refrigerant pipe from the exit of the outdoor heat exchanger 4 to the internal heat exchanger 20, the amount of refrigerant in the refrigeration cycle 1 can be reduced, and consequently, the volume concentration of the indoor refrigerant can be prevented from reaching a flammable concentration range.

[Heating Operation]

The flow passages in the flow switching device 3 in the heating operation are indicated by dashed lines of FIG. 1. Thus, when the compressor 2 is started up, the refrigerant in the refrigeration cycle 1 flows in a dashed arrow direction of FIG. 1. In more detail, when the compressor 2 is started up, the refrigerant is sucked through the suction port of the compressor 2. Then, this refrigerant becomes high-temperature high-pressure gaseous refrigerant and is discharged through the discharge port of the compressor 2. The high-temperature high-pressure gaseous refrigerant discharged from the compressor 2 flows into the indoor heat exchanger 6, heats the indoor air, and flows from the indoor heat exchanger 6.

The refrigerant flowing from the indoor heat exchanger 6 passes through the refrigerant pipe 13 and flows into the third flow passage 23 of the internal heat exchanger 20. This refrigerant is cooled in the internal heat exchanger 20 by low-temperature refrigerant flowing from the outdoor heat exchanger 4 into the first flow passage 21 of the internal heat exchanger 20. Thus, the refrigerant flowing from the indoor heat exchanger 6 into the third flow passage 23 of the internal heat exchanger 20 is liquefied and flows from the internal heat exchanger 20 into the expansion device 5. In FIG. 1, the refrigerant flowing through the first flow passage 21 of the internal heat exchanger 20 and the refrigerant flowing through the third flow passage 23 of the internal heat exchanger 20 are in parallel flow. However, these flows of the refrigerant are only examples. The refrigerant flowing through the first flow passage 21 and the refrigerant flowing through the third flow passage 23 may be in counter flow.

The liquid refrigerant flowing into the expansion device 5 is decompressed by the expansion device 5 to be brought into a low-temperature two-phase gas-liquid state and flows from the expansion device 5. The low-temperature two-phase gas-liquid refrigerant flowing from the expansion device 5 passes through the refrigerant pipe 12 and the second flow passage 22 of the internal heat exchanger 20 and flows into the outdoor heat exchanger 4. As the temperature of the refrigerant flowing through the second flow passage 22 of the internal heat exchanger 20 is low, this refrigerant passes through the second flow passage 22 while exchanging almost no heat with the refrigerant flowing through the first flow passage 21 of the internal heat exchanger 20. In FIG. 1, the refrigerant flowing through the first flow passage 21 of the internal heat exchanger 20 and the refrigerant flowing through the second flow passage 22 of the internal heat exchanger 20 are in counter flow. However, these flows of the refrigerant are only examples. The refrigerant flowing through the first flow passage 21 and the refrigerant flowing through the second flow passage 22 may be in parallel flow.

The refrigerant flowing into the outdoor heat exchanger 4 receives heat from the outdoor air, and then, flows from the outdoor heat exchanger 4. Here, as described above, the refrigerant flowing from the indoor heat exchanger 6 is cooled in the third flow passage 23 of the internal heat exchanger 20 according to Embodiment 1, thereby increasing the degree of subcooling. Thus, the specific enthalpy h of the refrigerant decompressed by the expansion device 5 and flowing into the outdoor heat exchanger 4 is small. Consequently, the air-conditioning apparatus 100 according to Embodiment 1 can increase the heat exchange amount in the outdoor heat exchanger 4. That is, the performance of the refrigeration cycle 1 can be improved.

The refrigerant flowing from the outdoor heat exchanger 4 passes through the refrigerant pipe 11 and flows into the first flow passage 21 of the internal heat exchanger 20. This refrigerant is heated in the internal heat exchanger 20 by the low-temperature refrigerant flowing from the indoor heat exchanger 6 into the third flow passage 23 of the internal heat exchanger 20. Thus, the refrigerant flowing into the first flow passage 21 of the internal heat exchanger 20 is gasified and flows from the internal heat exchanger 20. Consequently, the air-conditioning apparatus 100 according to Embodiment 1 can cause the two-phase gas-liquid refrigerant to flow from the outdoor heat exchanger 4. When the internal heat exchanger 20 is not provided, gaseous refrigerant has to be caused to flow from the outdoor heat exchanger 4 to prevent liquid back from occurring in the compressor 2. That is, the gaseous refrigerant flows in the vicinity of the exit of the outdoor heat exchanger 4. However, the gaseous refrigerant has a lower heat transfer coefficient compared to that of the two-phase gas-liquid refrigerant. As the air-conditioning apparatus 100 according to Embodiment 1 includes the internal heat exchanger 20, the two-phase gas-liquid refrigerant can be caused to flow from the outdoor heat exchanger 4, thereby improving the heat transfer performance of the outdoor heat exchanger 4. Consequently, the performance of the refrigeration cycle 1 can be further improved.

The gaseous refrigerant flowing from the first flow passage 21 of the internal heat exchanger 20 is sucked through the suction port of the compressor 2 and compressed into high-temperature high-pressure gaseous refrigerant again by the compressor 2.

Here, when the air-conditioning apparatus 100 is started up, the refrigerant stagnates in (is in the liquid state and stored in) the components such as the outdoor heat exchanger 4. Thus, the flow rate of the refrigerant circulating in the refrigeration cycle 1 is reduced. Also when the refrigerant leaks from the refrigeration cycle 1, the flow rate of the refrigerant circulating in the refrigeration cycle 1 is reduced. In such a state in which the flow rate of refrigerant circulating in the refrigeration cycle 1 is reduced, the refrigerant flowing from the indoor heat exchanger 6 is easily brought into the two-phase gas-liquid state. Thus, when the internal heat exchanger 20 is not provided, the two-phase gas-liquid refrigerant flows into the expansion device 5. When the two-phase gas-liquid refrigerant flows into the expansion device 5 as described above, the flow rate of refrigerant flowing through the expansion device 5 becomes unstable, and consequently, the high pressure and the low pressure of the refrigeration cycle become unstable. Furthermore, when the flow rate of refrigerant flowing through the expansion device 5 becomes unstable, the expansion device 5 generates noise.

However, with the air-conditioning apparatus 100 according to Embodiment 1 including the internal heat exchanger 20, even when the two-phase gas-liquid refrigerant flows from the indoor heat exchanger 6, this refrigerant is cooled by the internal heat exchanger 20, liquefied, and flows into the expansion device 5. Consequently, the air-conditioning apparatus 100 according to Embodiment 1 can prevent the high pressure and the low pressure of the refrigeration cycle from becoming unstable when the air-conditioning apparatus 100 is started up and prevent generation of noise from the expansion device 5.

After a transition period immediately following the startup has elapsed and a stable state has been brought in which the refrigerant stagnating in the components such as the outdoor heat exchanger 4 circulates, the liquid refrigerant or the two-phase gas-liquid refrigerant may be caused to flow through the refrigerant pipe from the exit of the indoor heat exchanger 6 to the internal heat exchanger 20.

When the liquid refrigerant is caused to flow through the refrigerant pipe from the exit of the indoor heat exchanger 6 to the internal heat exchanger 20, compared to the case where the two-phase gas-liquid refrigerant flows through the refrigerant pipe from the exit of the indoor heat exchanger 6 to the internal heat exchanger 20, the specific enthalpy h of the refrigerant decompressed by the expansion device 5 and flowing into the outdoor heat exchanger 4 is smaller. Thus, compared to the case where the two-phase gas-liquid refrigerant flows through the refrigerant pipe from the exit of the indoor heat exchanger 6 to the internal heat exchanger 20, when the liquid refrigerant is caused to flow through the refrigerant pipe from the exit of the indoor heat exchanger 6 to the internal heat exchanger 20, the heat exchange amount in the outdoor heat exchanger 4 can be further increased, and consequently, the performance of the refrigeration cycle 1 can be further improved.

In contrast, in the air-conditioning apparatus 100, compared to the case where the liquid refrigerant is caused to flow through the refrigerant pipe from the exit of the indoor heat exchanger 6 to the internal heat exchanger 20, when the two-phase gas-liquid refrigerant is caused to flow through the refrigerant pipe from the exit of the indoor heat exchanger 6 to the internal heat exchanger 20, the amount of refrigerant filled in the refrigeration cycle 1 can be reduced. R32, HFO1234yf, HFO1234ze, HFO1123, and hydrocarbon are flammable refrigerants. Consequently, when any of these refrigerants is used, the refrigerant is desired to be prevented from leaking to the room and being stored in the room, and the volume concentration of the refrigerant in the room is desired to be prevented from reaching a flammable concentration range. With the air-conditioning apparatus 100 according to Embodiment 1, by causing the two-phase gas-liquid refrigerant to flow through the refrigerant pipe from the exit of the indoor heat exchanger 6 to the internal heat exchanger 20, the amount of refrigerant in the refrigeration cycle 1 can be reduced, and consequently, the volume concentration of the indoor refrigerant can be prevented from reaching a flammable concentration range.

With the air-conditioning apparatus 100 according to Embodiment 1 having been described, only by using a single internal heat exchanger 20 and a single expansion device 5, the degree of subcooling of the refrigerant flowing from the condenser can be increased to improve the performance of the refrigeration cycle 1 in both the cooling operation and the heating operation. Furthermore, with the air-conditioning apparatus 100 according to Embodiment 1, a bridge circuit that includes four check valves is not required for the refrigeration cycle 1. Consequently, with the air-conditioning apparatus 100 according to Embodiment 1, the cost and space can be reduced compared to the related art air-conditioning apparatus.

Embodiment 2

The internal heat exchanger 20 that can be used for the air-conditioning apparatus 100 is not limited to the internal heat exchanger 20 of FIG. 2. For example, in the case of the internal heat exchanger 20 of FIG. 2, a part of the refrigerant pipe 12 and a part of the refrigerant pipe 13 included in the internal heat exchanger 20 (the parts wound around the refrigerant pipe 11) are disposed close to each other. That is, in the internal heat exchanger 20 of FIG. 2, the second flow passage 22 that guides the refrigerant flowing between the outdoor heat exchanger 4 and the expansion device 5 and the third flow passage 23 that guides the refrigerant flowing between the expansion device 5 and the indoor heat exchanger 6 are disposed close to each other. When the internal heat exchanger 20 is configured as above, the heat exchange amount of the evaporator may be slightly reduced by heating the refrigerant passing through the internal heat exchanger 20 and flowing into the evaporator by the refrigerant flowing from the condenser into the internal heat exchanger 20. To also eliminate such a slight concern, the internal heat exchanger 20 may be configured as the internal heat exchanger 20 according to Embodiment 2. The elements not described in Embodiment 2 are similar to those of Embodiment 1, and the elements similar to those of Embodiment 1 are denoted by the same reference signs as those of Embodiment 1.

The internal heat exchanger 20 according to Embodiment 2 is configured so that the first flow passage 21 that guides the refrigerant flowing between the evaporator and the compressor 2 is formed between the second flow passage 22 that guides the refrigerant flowing between the outdoor heat exchanger 4 and the expansion device 5 and the third flow passage 23 that guides the refrigerant flowing between the expansion device 5 and the indoor heat exchanger 6. When the internal heat exchanger 20 is configured as above, the occurrences of a situation in which the refrigerant passing through the internal heat exchanger 20 and flowing into the evaporator is heated by the refrigerant flowing from the condenser into the internal heat exchanger 20 can be reduced, and consequently, the above-described slight concern can be eliminated.

Specifically, the internal heat exchanger 20 according to Embodiment 2 can be configured, for example, as follows.

Figure 4:
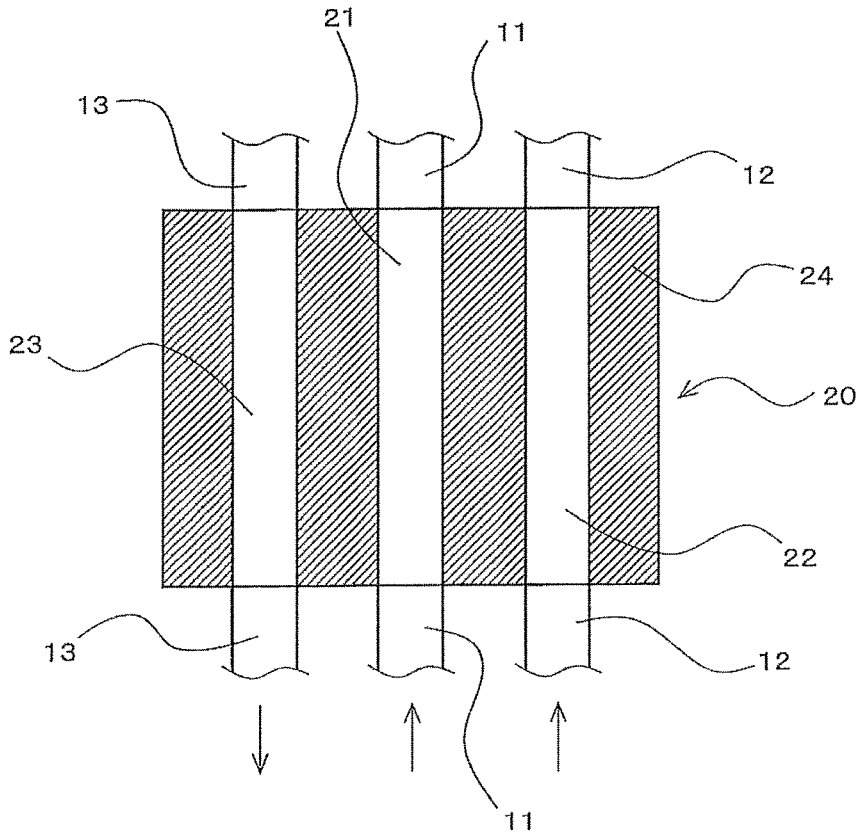
FIG. 4 is a sectional view of an example of the internal heat exchanger of the air-conditioning apparatus according to Embodiment 2 of the present invention.

FIG. 4 is a sectional view of an example of the internal heat exchanger of the air-conditioning apparatus according to Embodiment 2 of the present invention. FIG. 4 illustrates a section of the internal heat exchanger 20 taken along directions of the refrigerant flowing through the first flow passage 21, the second flow passage 22, and the third flow passage 23. In FIG. 4, arrows other than leader lines indicate directions of the refrigerant flows. The directions of the refrigerant flows are only examples. The refrigerant may flow in opposite directions to the arrow directions.

The internal heat exchanger 20 of FIG. 4 is configured so that the first flow passage 21, the second flow passage 22, and the third flow passage 23 are arranged parallel to one another in a heat transfer member 24. The heat transfer member 24 is formed of, for example, metal. Furthermore, the first flow passage 21 is disposed between the second flow passage 22 and the third flow passage 23. The first flow passage 21 is connected to the refrigerant pipe 11, the second flow passage 22 is connected to the refrigerant pipe 12, and the third flow passage 23 is connected to the refrigerant pipe 13 in the internal heat exchanger 20. In other words, the first flow passage 21 is provided in a middle portion of the refrigerant pipe 11, the second flow passage 22 is provided in a middle portion of the refrigerant pipe 12, and the third flow passage 23 is provided in a middle portion of the refrigerant pipe 13 in the internal heat exchanger 20.

When the internal heat exchanger 20 is configured as illustrated in FIG. 4, the occurrences of a situation in which the refrigerant flowing from the condenser into the internal heat exchanger 20 (the refrigerant flowing through one of the second flow passage 22 and the third flow passage 23) heats the refrigerant passing through the internal heat exchanger 20 and flowing into the evaporator (the refrigerant flowing through the other of the second flow passage 22 and the third flow passage 23) can be reduced.

The internal heat exchanger 20 according to Embodiment 2 is not limited to the internal heat exchanger 20 of FIG. 4.

Figure 5:
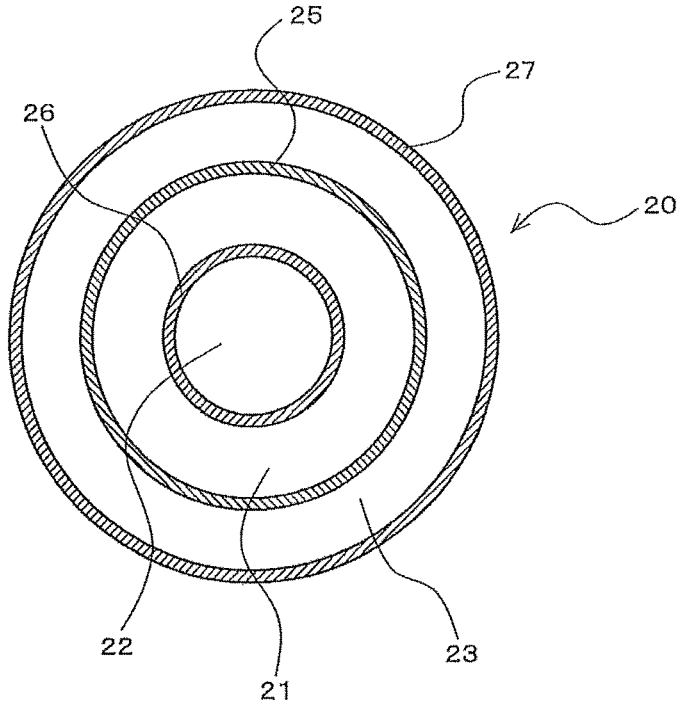
FIG. 5 is a sectional view of another example of the internal heat exchanger of the air-conditioning apparatus according to Embodiment 2 of the present invention.
Figure 6:
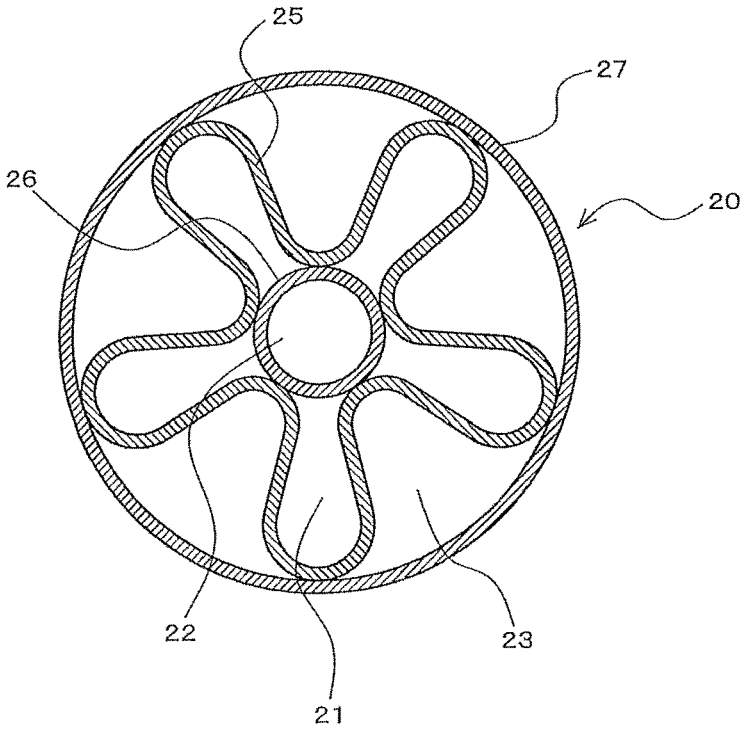
FIG. 6 is a sectional view of another example of the internal heat exchanger of the air-conditioning apparatus according to Embodiment 2 of the present invention.

FIGS. 5 and 6 are sectional views of other examples of the internal heat exchanger of the air-conditioning apparatus according to Embodiment 2 of the present invention. These FIGS. 5 and 6 illustrate internal heat exchangers 20 each taken along a section perpendicular to the directions of the refrigerant flowing through the first flow passage 21, the second flow passage 22, and the third flow passage 23.

The internal heat exchangers 20 of FIGS. 5 and 6 each include a first heat transfer pipe 25 in which the first flow passage 21 is formed, a second heat transfer pipe 26 in which the second flow passage 22 is formed, and a third heat transfer pipe 27 in which the third flow passage 23 is formed. Furthermore, in each of the internal heat exchangers 20 of FIGS. 5 and 6, the first heat transfer pipe 25 is disposed on the inner circumferential side of the third heat transfer pipe 27, and the second heat transfer pipe 26 is disposed on the inner circumferential side of the first heat transfer pipe 25. When the internal heat exchanger 20 is configured as above, the second flow passage 22 and the third flow passage 23 are separated from each other by the first flow passage 21. Thus, compared to the internal heat exchanger 20 of FIG. 4, the internal heat exchangers 20 configured as illustrated in FIGS. 5 and 6 can further reduce the occurrences of a situation in which the refrigerant flowing from the condenser into the internal heat exchanger 20 (the refrigerant flowing through one of the second flow passage 22 and the third flow passage 23) heats the refrigerant passing through the internal heat exchanger 20 and flowing into the evaporator (the refrigerant flowing through the other of the second flow passage 22 and the third flow passage 23).

Here, in the internal heat exchanger 20 of FIG. 5, the first heat transfer pipe 25, the second heat transfer pipe 26, and the third heat transfer pipe 27 are formed by circular pipes. In contrast, in the internal heat exchanger 20 of FIG. 6, while the second heat transfer pipe 26 and the third heat transfer pipe 27 are formed by circular pipes, the first heat transfer pipe 25 is a multilobed heat transfer pipe. The multilobed heat transfer pipe refers to a heat transfer pipe including a plurality of projections (projecting paths) formed at an outer circumference portion of a heat transfer pipe. That is, the multilobed heat transfer pipe has a plurality of flow passages projecting toward the outer circumferential side when the heat transfer pipe is cut in a section perpendicular to the direction of the refrigerant flow. The internal heat exchanger 20 of FIG. 5 can be configured only with simply shaped heat transfer pipes. Thus, with the internal heat exchanger 20 of FIG. 5, an effect of facilitating production of the internal heat exchanger compared to the internal heat exchanger of FIG. 6 can be obtained. Alternatively, with the internal heat exchanger 20 of FIG. 6, an effect of increasing a heat transfer area between the refrigerant flowing through the first flow passage 21 and the refrigerant flowing through the third flow passage 23 compared to the internal heat exchanger 20 of FIG. 5 can be obtained.

In the internal heat exchanger 20 of either of FIGS. 5 and 6, naturally, the first heat transfer pipe 25 may be disposed on the inner circumferential side of the second heat transfer pipe 26, and the third heat transfer pipe 27 may be disposed on the inner circumferential side of the first heat transfer pipe 25.

REFERENCE SIGNS LIST

1 refrigeration cycle 2 compressor 3 flow switching device 4 outdoor heat exchanger (heat source side heat exchanger) **4*a* outdoor fan 5 expansion device 6 indoor heat exchanger (use side heat exchanger) 6*a* indoor fan 11 refrigerant pipe 12 refrigerant pipe 13 refrigerant pipe 20 internal heat exchanger 21 first flow passage 22 second flow passage 23 third flow passage 24 heat transfer member 25 first heat transfer pipe 26 second heat transfer pipe 27 third heat transfer pipe 30 controller 100** air-conditioning apparatus

The invention claimed is:

1. An air-conditioning apparatus comprising:

a compressor configured to compress a refrigerant;

a flow switching device configured to switch a flow passage of the refrigerant discharged from the compressor between a flow passage used for a cooling operation and a flow passage used for a heating operation;

a heat source side heat exchanger serving as a condenser in the cooling operation and as an evaporator in the heating operation;

an expansion device configured to expand and decompress the refrigerant;

a use side heat exchanger serving as an evaporator in the cooling operation and as a condenser in the heating operation; and an internal heat exchanger configured to exchange heat between the refrigerant flowing through a plurality of heat transfer pipes, wherein the compressor, the heat source side heat exchanger, the expansion device, and the use side heat exchanger are sequentially connected to one another through a plurality of refrigerant pipes, and constitute a refrigeration cycle, wherein the flow switching device is connected to a discharge port of the compressor, a suction port of the compressor, the heat source side heat exchanger, and the use side heat exchanger, and the flow switching device is configured to connect the discharge port with the heat source side heat exchanger and connect the suction port with the use side heat exchanger in the cooling operation, and connect the discharge port with the use side heat exchanger and connect the suction port with the heat source side heat exchanger in the heating operation, wherein the refrigeration cycle includes a first flow passage guiding the refrigerant flowing between the one of the heat source side heat exchanger and the use side heat exchanger serving as the evaporator and the compressor, a second flow passage guiding the refrigerant flowing between the heat source side heat exchanger and the expansion device, and a third flow passage guiding the refrigerant flowing between the expansion device and the use side heat exchanger, wherein the first flow passage, the second flow passage, and the third flow passage are serially connected, and wherein the internal heat exchanger includes a first heat transfer pipe in which the first flow passage is formed, a second heat transfer pipe in which the second flow passage is formed, and a third heat transfer pipe in which the third flow passage is formed.

2. The air-conditioning apparatus of claim 1, wherein, in the internal heat exchanger, the second heat transfer pipe and the third heat transfer pipe are wound around an outer circumference portion of the first heat transfer pipe.

3. The air-conditioning apparatus of claim 1, wherein the refrigerant contains at least one of R32, HFO1234yf, HFO1234ze, HFO1123, and hydrocarbon.

4. The air-conditioning apparatus of claim 1, wherein the internal heat exchanger is configured to exchange heat between the refrigerant flowing through the first flow passage and the refrigerant flowing through the second flow passage in the cooling operation, and exchange heat between the refrigerant flowing through the first flow passage and the refrigerant flowing through the third flow passage in the heating operation.

5. The air-conditioning apparatus of claim 1, wherein, in the internal heat exchanger, the first flow passage is formed between the second flow passage and the third flow passage.

6. The air-conditioning apparatus of claim 5, wherein, in the internal heat exchanger, the first flow passage, the second flow passage, and the third flow passage are arranged parallel to one another in a heat transfer member, and the first flow passage is disposed between the second flow passage and the third flow passage.

7. The air-conditioning apparatus of claim 5, wherein, in the internal heat exchanger, the first heat transfer pipe is disposed on an inner circumferential side of one of the second heat transfer pipe and the third heat transfer pipe, and an other of the second heat transfer pipe and the third heat transfer pipe is disposed on an inner circumferential side of the first heat transfer pipe.

8. The air-conditioning apparatus of claim 7, wherein the first heat transfer pipe, the second heat transfer pipe, and the third heat transfer pipe each comprise a circular pipe.

9. The air-conditioning apparatus of claim 7, wherein the first heat transfer pipe comprises a multilobed heat transfer pipe.

* * * * *